US006409634B1

(12) United States Patent
Profaci

(10) Patent No.: US 6,409,634 B1
(45) Date of Patent: Jun. 25, 2002

(54) SWIM TRAINING APPARATUS

(76) Inventor: John Profaci, 16 Dehart Rd., Maplewood, NJ (US) 07040

( * ) Notice: Subject to any disclaimer, the term of this patent is extended or adjusted under 35 U.S.C. 154(b) by 0 days.

(21) Appl. No.: 09/624,920

(22) Filed: Jul. 25, 2000

(51) Int. Cl.[7] ..... A63B 69/10
(52) U.S. Cl. ..... 482/56; 434/254
(58) Field of Search ..... 482/51, 55, 56, 482/148; 434/254

(56) References Cited

U.S. PATENT DOCUMENTS

| | | | | |
|---|---|---|---|---|
| 149,249 | A | | 3/1874 | Redfearn |
| 326,247 | A | | 9/1885 | Root |
| 350,932 | A | | 10/1886 | Keating |
| 1,176,365 | A | | 3/1916 | Hartnett |
| 1,966,448 | A | | 7/1934 | Kabisius |
| 2,434,542 | A | | 1/1948 | Borroughs |
| 2,497,391 | A | | 2/1950 | Becker |
| 3,074,716 | A | | 1/1963 | Mitchel et al. |
| 3,721,438 | A | * | 3/1973 | Kusmer ..... 272/71 |
| 3,731,921 | A | | 5/1973 | Andrews, Jr. |
| 3,791,646 | A | | 2/1974 | Marchignoni |
| 4,422,634 | A | | 12/1983 | Hopkins |
| 4,537,396 | A | | 8/1985 | Hooper |
| 4,674,740 | A | | 6/1987 | Iams et al. |
| 4,830,363 | A | | 5/1989 | Kennedy |
| 4,844,450 | A | | 7/1989 | Rodgers, Jr. |
| 4,948,119 | A | | 8/1990 | Robertson, Jr. |
| 5,158,513 | A | | 10/1992 | Reeves |
| 5,282,748 | A | | 2/1994 | Little |
| 5,393,280 | A | | 2/1995 | Haviv |
| 5,540,591 | A | | 7/1996 | Doane |
| 5,957,815 | A | | 9/1999 | Labrenz |

FOREIGN PATENT DOCUMENTS

| | | |
|---|---|---|
| DE | 485304 | 7/1927 |
| FR | 831721 | 9/1938 |
| GB | 221098 | 9/1924 |
| GB | 369829 | 3/1932 |
| WO | WO 8601420 | 3/1986 |

* cited by examiner

*Primary Examiner*—Stephen R. Crow
(74) *Attorney, Agent, or Firm*—Gary M. Cohen

(57) ABSTRACT

A swim training apparatus which is simplified for use by a novice, toddler or child not yet ready to enter the water or just learning to swim is generally comprised of two shell sections defining an enclosure for housing a mechanism for facilitating the training process. The defined enclosure receives a pair of hand track systems which are connected by a cable so that the retraction of a hand grip associated with one of the hand track systems automatically causes the hand grip associated with the other one of the hand track systems to advance to a position which is appropriate for engagement by the opposite hand of the user of the apparatus, in an alternating fashion which simulates a swimming stroke. The hand track systems are configured so that the hand grip which is grasped by the user remains exposed during retraction of the hand grip, and so that the remaining hand grip is contained within the enclosure until such time as it has been advanced forward for engagement by the user's other hand. In this way, the user is prompted to alternatingly and successively reach for one of the hand grips, while leaving the other hand (and arm) free to simulate the recovery portion of the swimming stroke, and to promote safety by removing potentially interfering structures from the user's field of motion.

32 Claims, 7 Drawing Sheets

SWIM TRAINING APPARATUS

BACKGROUND OF THE INVENTION

The present invention generally relates to a swim training apparatus, and more particularly, to an apparatus that can be used to teach, exercise and practice basic swimming skills.

There are a variety of situations where it would be desirable to have the availability of a device that can either help teach a non-swimmer proper stroking form, such as a basic freestyle stroke, or to allow a person with prior knowledge of a stroke, once learned, to practice and/or to strengthen his or her form. In many cases, particularly for a beginner, it would be desirable to allow the stroke to be learned while out of the water, to gain a basic understanding of the stroke and to develop an appropriate level of confidence prior to entering the water. It would also be desirable to allow a swimmer that has learned the basic form for a particular stroke to practice his or her form while out of the water. This would allow a trainer to better view the swimmer's form, for purposes of improving that form. This could also be beneficial in situations where the user is a child not yet of an age or level of skill sufficient to enter a swimming pool without a significant amount of supervision.

A variety of sports training devices have been devised to facilitate the training of individuals in the exercise and practice of various swimming techniques (i.e., strokes). These devices have primarily relied upon relatively complex mechanical arrangements to define the arm and/or leg motion desired for the particular swimming stroke being practiced. Early devices often used pull-strings, rotating handles and other similar mechanisms for this purpose, and were generally found to suffer from the shortcoming that each operated to emphasize the development and practice of swimming mechanics by emphasizing and developing arm and shoulder pulling strength, or leg kicking strength. This was found to be self-limiting since swimming does not rely entirely on muscle strength, but rather is heavily reliant upon the development of proper swimming technique and the ability to develop efficient swimming habits. This was found to be particularly important for novice swimmers, especially in the case of toddlers and young children first learning to swim.

U.S. patent application Ser. No. 09/197,084 discloses a more advanced swim training apparatus, and the subject matter of this disclosure is incorporated by reference as if fully set forth herein. The disclosed apparatus operates to correctly simulate the various attributes of a correctly executed swimming stroke (e.g., a crawl or freestyle stroke) by combining a rotatable table for receiving the user with a hand track system which simulates the overall attributes of the desired stroke. The hand track system includes paired paddle systems for receiving the user's hands during the various phases of the stroke being exercised. This, in turn, operates to guide the user's hands and arms into their correct position during the simulated stroke while allowing the hands and arms to freely progress without interference from the operative components associated with the hand track system.

The system disclosed in U.S. patent application Ser. No. 09/197,084 works well to facilitate the training of more complex and advanced swimming strokes. However, such a device can in certain circumstances be more advanced than is necessary or appropriate for more basic learning experiences. An example of this would be initial training in a basic swimming technique, such as in situations where the swimmer is a novice, toddler or young child not yet possessing a level of experience or sufficient skill to enter a swimming pool without adult supervision. Accordingly, it has become desirable to develop a swim training apparatus which is more suited to such needs.

SUMMARY OF THE INVENTION

Such improvements are achieved in accordance with the present invention by providing a swim training apparatus having many of the attributes of the apparatus disclosed in U.S. patent application Ser. No. 09/197,084, but which has been simplified to better suit the needs of a novice, toddler or young child first learning to swim.

To this end, the swim training apparatus of the present invention is generally comprised of two shell sections defining an enclosure for housing the mechanism which will be used to facilitate the training process. The defined enclosure receives a pair of hand track systems which are connected by a cable so that the retraction of a hand grip associated one of the hand track systems automatically causes the hand grip associated the other one of the hand track systems to advance to a position which is appropriate for engagement by the opposite hand of the user of the apparatus, in an alternating fashion which simulates the basic swimming stroke. Each of the hand track systems are configured so that the hand grip which is being grasped by the user remains exposed during retraction of the hand grip (i.e., while simulating a swimming stroke), and so that the remaining hand grip is contained within the enclosure until such time as it has been advanced forward, for engagement by the user's other hand (i.e., to simulate a subsequent swimming stroke).

As a result, the user is prompted to alternatingly and successively reach for one of the hand grips, while leaving the other hand (and arm) free to simulate the recovery portion of the swimming stroke. Moreover, potentially interfering structures are removed from the user's field of motion, promoting safety in the course of the training process.

For further discussion of the swim training apparatus of the present invention, reference is made to the detailed description which is provided below, taken in conjunction with the following illustrations.

DETAILED DESCRIPTION OF PREFERRED EMBODIMENTS

Figure 1:
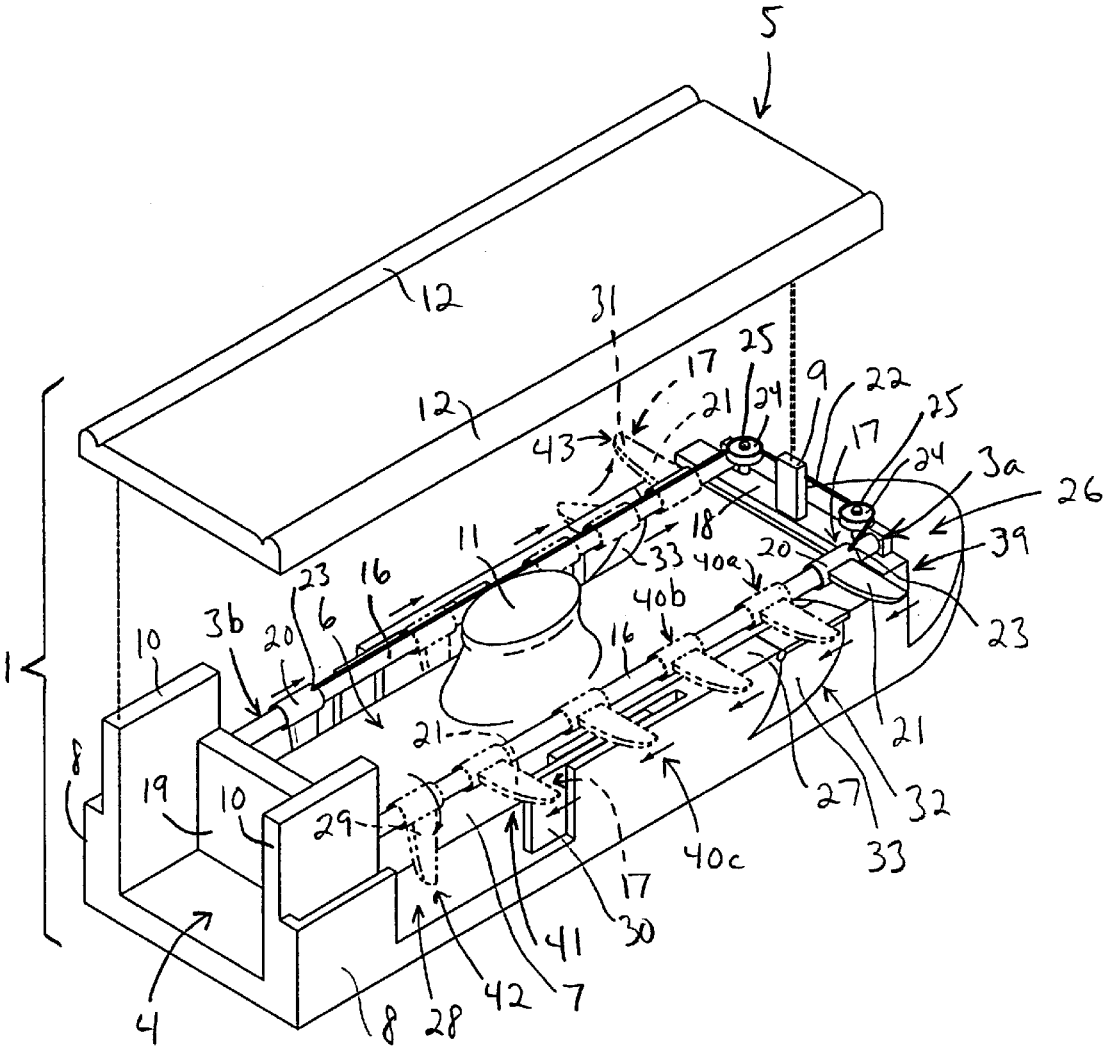
FIGS. 1 and 2 are isometric views showing operations of a preferred embodiment swim training apparatus produced in accordance with the present invention, with the cover of the apparatus exploded away to reveal internal construction.

FIG. 1 shows a preferred embodiment swim training apparatus 1 which is particularly well suited to the instruction of a novice swimmer, toddler or young child not yet of an age or level of skill sufficient to enter a swimming pool without close supervision. It will be appreciated that the apparatus 1 can be used to simulate any of a variety of swimming strokes, if desired. However, for purposes of the description which follows, it will be assumed that the user is learning a rudimentary stroke sufficient to successfully navigate a body of water utilizing an alternating arm motion characteristic of a basic "freestyle" or "doggy paddle" stroke.

The swim training apparatus 1 is generally comprised of an enclosure 2 which houses a pair of hand track systems 3*a*, 3*b*. The enclosure 2 is comprised of two shell sections 4, 5 which combine to define a housing 6 for receiving the pair of hand track systems 3*a*, 3*b*. The lower shell section 4 constitutes a body for receiving the various structural elements of the apparatus 1, as will be described more fully below. The upper shell section 5 constitutes a cover for enclosing the body 4 and is configured to receive a user so that the user is supported in a generally horizontal orientation similar to the position the user would assume while in the water, and so that the hands and arms of the user can extend freely from the enclosure 2 toward the hand track systems 3*a*, 3*b*. The hand track systems 3*a*, 3*b* can then be engaged by the hands of the user, as will be discussed more fully below, for purposes of simulating the desired swimming stroke. It will be understood that the swim training apparatus 1 can be modified from the illustrative configuration which is shown in FIGS. 1 to 9 to simulate any of a number of different swimming strokes, if desired, and that the enclosure 2 can be provided with any of a number of visually pleasing configurations (e.g., an ornamental design simulating a Dolphin, Orca or other aquatic theme) to make the apparatus more appealing to toddlers and younger children.

Referring again to FIGS. 1 and 2, the body 4 includes a base 7 and opposing, laterally extending side walls 8. Front and rear supports 9, 10 are provided for receiving the cover 5 and for retaining the cover 5 in position over the body 4 to develop the previously described housing 6. A pedestal 11 preferably extends upwardly from central portions of the base 7 to provide added support for cental portions of the cover 5.

The cover 5 is generally flat in shape, for simplicity, which will be sufficiently useful for training a novice or small child. The lateral edges 12 of the cover 5 are preferably padded to minimize impacts with the user's hands and arms while using the apparatus. If desired, the lateral edges 12 can be provided with bolsters 13 (shown in FIG. 3) or vertical projections 14 (shown in FIG. 4) extending along portions of the cover 5 that are not adjacent to the user's shoulders (e.g., adjacent to the head, the lower body and/or the feet) for added safety. The cover 5 can also be provided with a contoured shape, such as a concave shape 15 (shown in FIG. 5) which is adapted to receive the user's body in a more confined space, or a concave tray (not shown) which is capable of permitting the user's body to rotate as the swimming stroke is simulated (as is described, for example, in U.S. patent application Ser. No. 09/197,084).

One of the hand track systems 3*a*, 3*b* is mated with each of the sides 8 of the body 4. Each of the hand track systems 3*a*, 3*b* generally includes a rail 16 which is positioned inboard from its adjacent side wall 8, and a paddle assembly 17 which is slidingly received by the rail 16 for longitudinal movement along the rail 16 and for free rotation about a longitudinal axis which is defined by the rail 16.

The rail 16 is in each case mounted to a front wall 18 and a rear wall 19 so that the paddle assembly 17 can assume either of two configurations. In one configuration, the paddle assembly 17 is positioned to engage and slide along the adjacent side wall 8 of the body 4, constituting a raised position for engagement by the user to simulate a swimming stroke. In another configuration, the paddle assembly 17 is positioned to hang vertically downwardly, extending within the enclosure 2, along the adjacent side wall 8 of the body 4, constituting a lowered position which precludes engagement of the paddle assembly 17 by the user.

Figure 2:
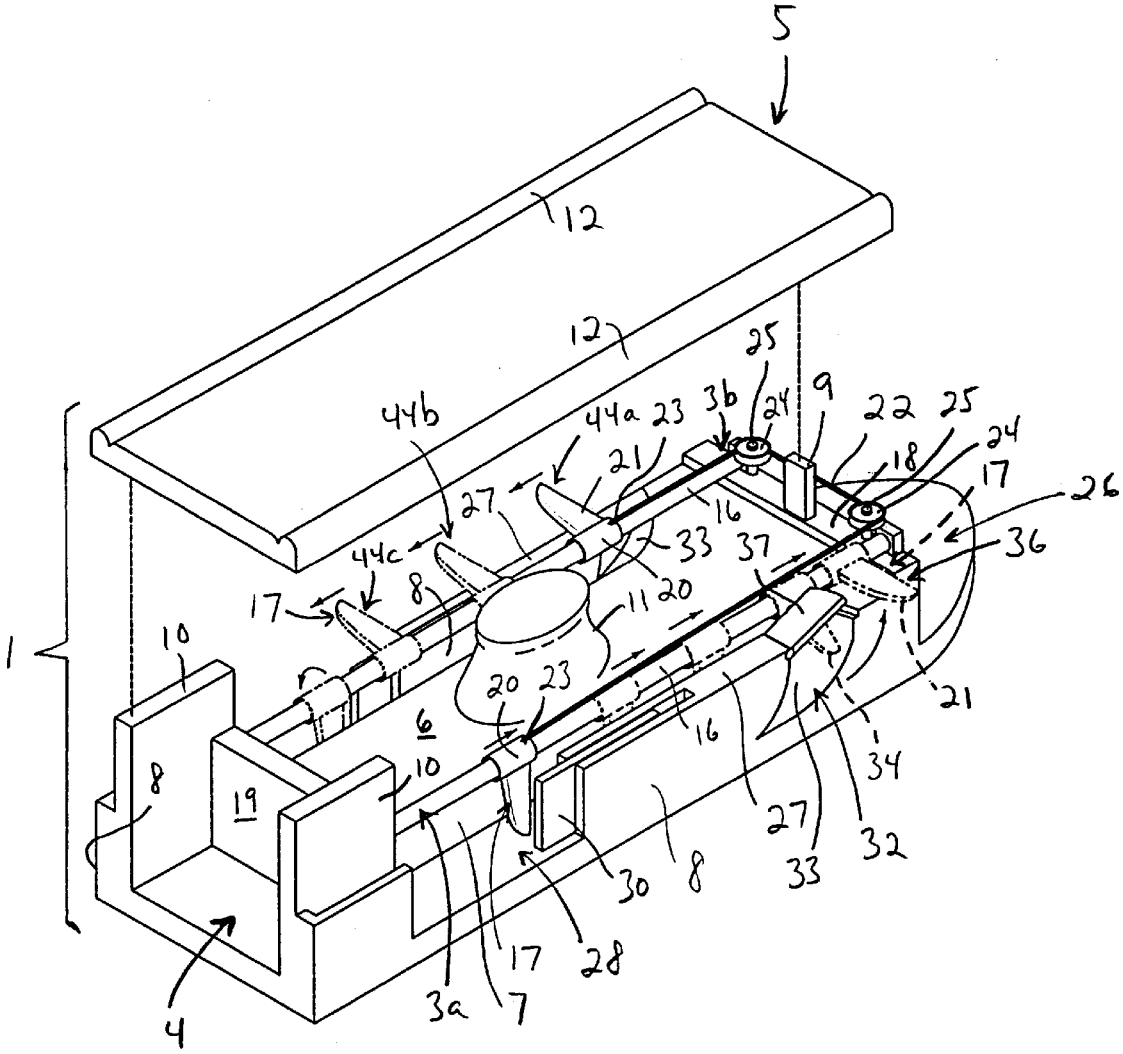
Figure 3:
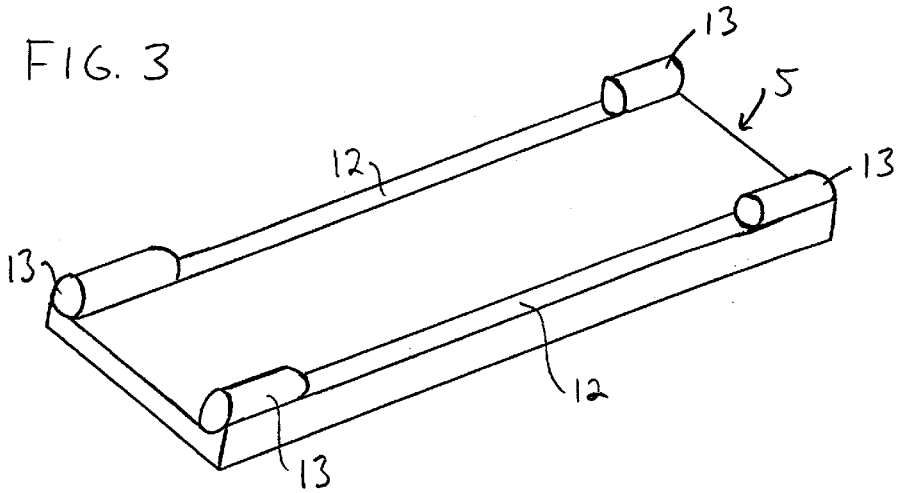
FIGS. 3 to 5 are isometric views showing alternative configurations for the cover of the apparatus shown in FIGS. 1 and 2.
Figure 4:
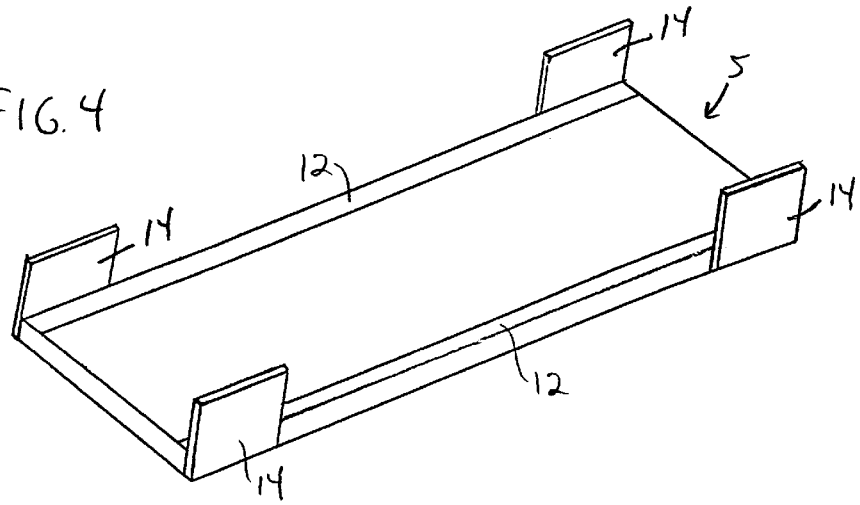
Figure 5:
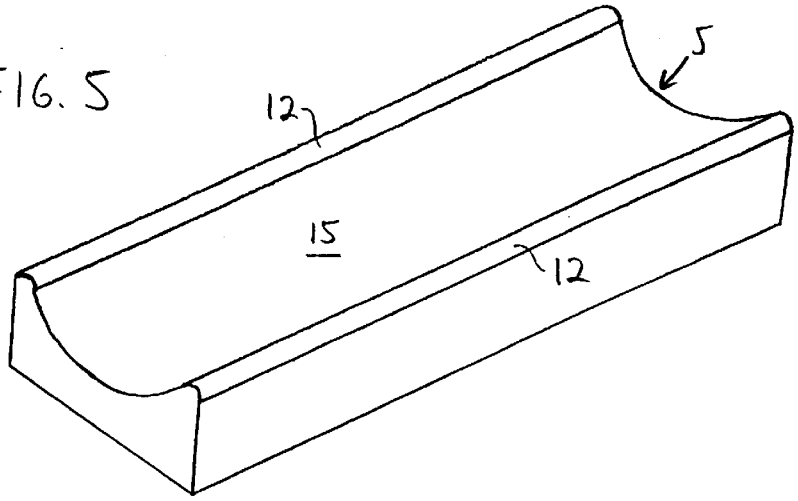
Figure 6:
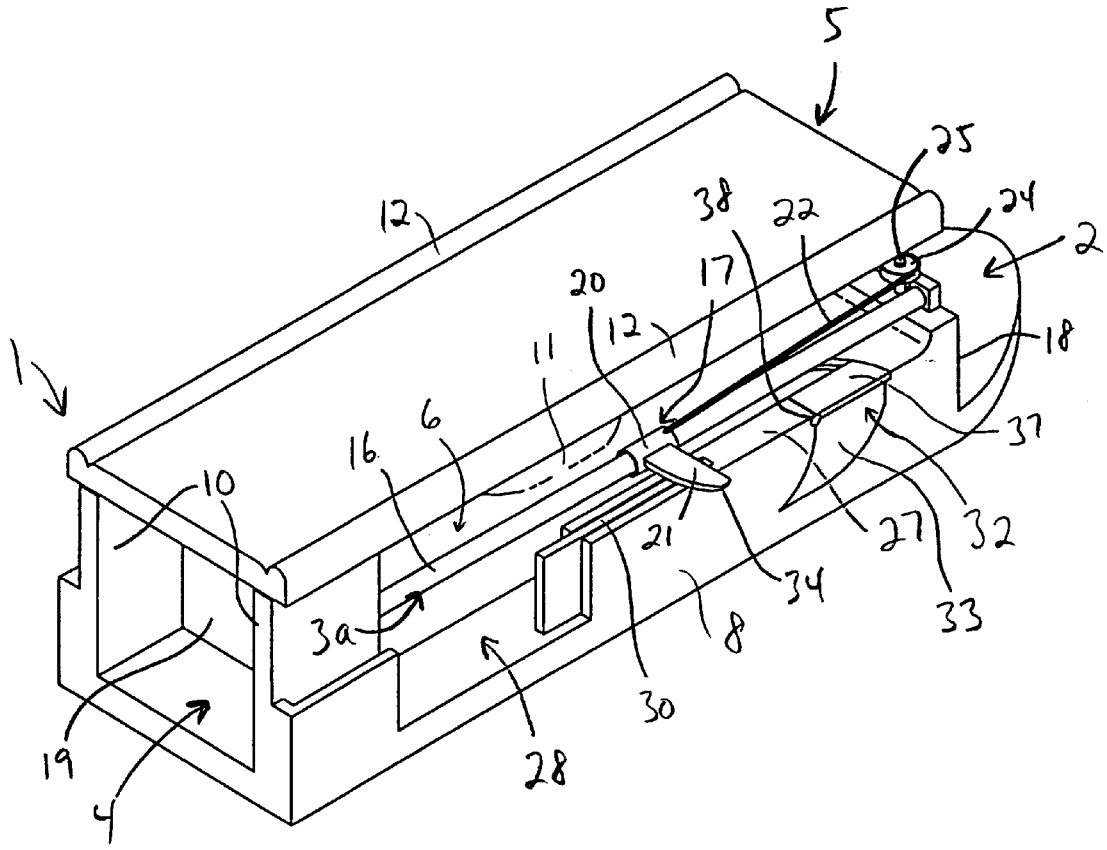
FIG. 6 is an isometric view corresponding to the views shown in FIGS. 1 and 2, with the cover of the apparatus in place and ready for use.
Figure 7:
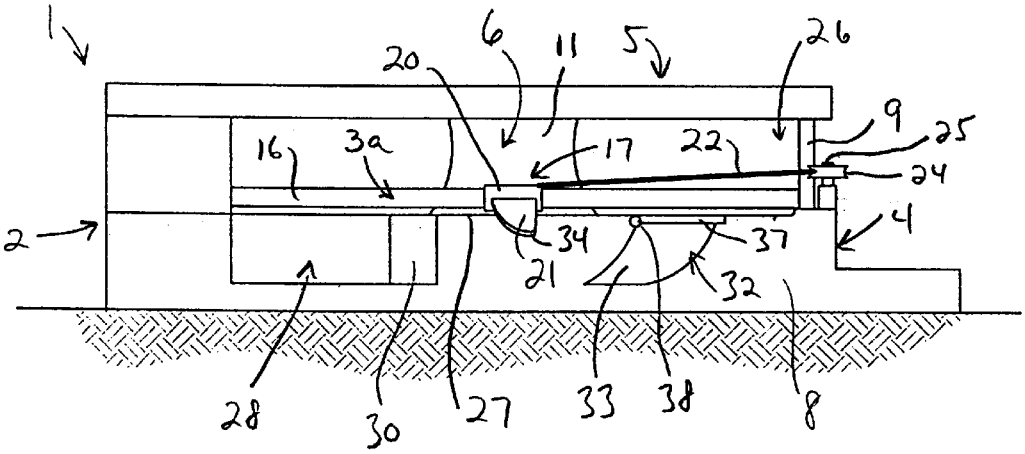
FIG. 7 is a side elevational view of the swim training apparatus shown in FIG. 6.

The rail 16 shown in FIGS. 1 and 2 is straight and uniform in configuration, simulating a simplified and linear path for the simulated swimming stroke. In this configuration, the paddle assembly 17 can be implemented as a cylindrical sleeve 20 which slidingly overlies the rail 16, and a hand grip 21 which extends from the sleeve 20 and which provides a surface for engagement by the user's hand when the paddle assembly 17 is in the raised position (resting upon the adjacent side wall 8). Some or all of the surfaces of the hand grip 21 can be padded, if desired, for comfort and for safety.

It will be understood that a simplified hand track system 3*a*, 3*b*, including the linear rail 16 and the basic paddle assembly 17 selected for illustration in the drawings, will be preferred for simplicity and for use in initial (basic) training procedures, but that other, more complex configurations can be developed for more complex training procedures and to simulate other swimming strokes, if desired. As an example, the linear rail 16 can be replaced with a contoured rail (not shown) to more closely simulate a desired swimming stroke, as described in U.S. patent application Ser. No. 09/197,084. In such case, the side walls 8 of the body 4 would have to be replaced with contoured walls having a shape which complements the shape of the contoured rails to develop the previously described raised and lowered operating positions. The sleeve 20 can be provided with one or more rollers (not shown) capable of riding on the rail 16, to assist in smooth movement of the sleeve 20 along the rail 16. The hand grip 21 can have the generally flat shape which is shown in the drawings, or a contoured shape which simulates a desired visual effect such as the "fin" or "flipper" of a Dolphin or the like. Any of a number of variations (for the rail 16 and for the paddle assembly 17) can be developed to simulate any of a variety of visual and/or functional effects.

The paddle assemblies 17 of the respective hand track systems 3*a*, 3*b* are interconnected by a cable 22 extending from the leading edge of each of the paddle assemblies, at 23. The cable 22 is preferably joined to the sleeve 20 of each of the paddle assemblies 17 so that the cable 22 remains within the confines of the enclosure 6. Any of a variety of mechanical expedients may be used to accomplish this connection (e.g., by knotting the ends of the cable 22 or using appropriate hardware). If desired, the cable 22 can be made connectable with the paddle assembly 17 at different points, or in some other dimensionally variable fashion, to allow the hand track systems 3*a*, 3*b* to be adjusted (in size) to the intended user.

A pair of pulleys 24 are preferably provided to receive the cable 22 and to guide the cable 22 between the coupled pair of paddle assemblies 17 so that retraction (rearward) of one of the paddle assemblies 17 automatically draws the opposing paddle assembly 17 forward, and vice versa, as is best illustrated in FIGS. 1 and 2. The pulleys 24 are received by a pair of axles 25 which are advantageously mounted to forward portions 26 of the body 4, on opposite sides of the support 9. The pulleys 24 are in each case preferably mounted to the forward portions 26 of the body 4 so that the cable 22 is placed in substantial alignment with the longitudinal axis which is defined by the rails 16 of the hand track systems 3*a*, 3*b*. The pulleys 24 are preferably positioned slightly above the rails 16 and sufficiently ahead of the forwardmost extension possible for the paddle assemblies 17 to maintain this alignment between the cable 22 and each of the rails 16 throughout the entire range of motion established for the paddle assemblies 17. Such alignment is considered important for promoting smooth travel of the paddle assemblies 17 fully along the rails 16, from end to end.

For some applications, it may be desirable to develop a limited amount of resistance in conjunction with retraction of the paddle assemblies 17. This capability can be developed by fitting the cable 22, the pulleys 24 and/or the sleeves 20 with a suitable, friction-developing mechanism. The resistance which is developed may be either fixed or variable.

As mentioned previously, it is preferable for the paddle assemblies 17 to be capable of assuming either of two configurations including a raised position, in which the hand grip 21 of the paddle assembly 17 can engage and slide along the adjacent side wall 8 of the body 4, and a lowered position, in which the hand grip 21 of the paddle assembly 17 can hang vertically downwardly, extending within the enclosure 2, along the inside of the adjacent side wall 8 of the body 4. This is considered important to prevent the user from coming in contact with the lowered hand grip 21.

Preventing contact with the lowered hand grip 21 prevents the user from accidentally striking the hand grip 21, which at that point is not in use, providing an added level of safety for the user. Moreover, lowering the unused hand grip 21 has the added advantage of preventing the user from engaging the hand grip 21 of the lowered paddle assembly 17 at times when the user's hand should be free to simulate the recovery portion of the swimming stroke which is being learned and practiced. This is particularly so for younger children, where there is often a natural tendency to simultaneously engage both of the hand grips 21, preventing the user from learning the appropriate skills.

Preferably, both the raised and the lowered positions for the hand grips 21 of the paddle assemblies 17 are established automatically, responsive to movements of the paddle assemblies 17 along the rails 16 of the hand track systems 3*a*, 3*b* by the user. To this end, and collectively referring to FIGS. 1, 2, 6 and 7, during the retraction of a raised (active) paddle assembly 17 (simulating the pull of a swimming stroke), the hand grip 21 is caused to proceed along the corresponding side wall 8, resting upon the sill 27 of the side wall 8. When the hand grip 21 is brought to a position which simulates the rearwardmost extension of the user's arm, the hand grip 21 is caused to progress beyond the sill 27 of the side wall 8, extending over an opening 28 formed in the side wall 8. As a result, when the hand grip 21 is released (at the end of its travel), the paddle assembly 17 is allowed to rotate downwardly, dropping into the enclosure 2 (shown at 29 in FIGS. 1 and 2). Each of the side walls 8 is provided with a sliding (pocket style) door 30, which is capable of retraction within the side wall 8 for purposes of adjusting the point at which the paddle assembly 17 will drop into the enclosure 2 to match the size of the intended user.

Retraction of the hand grip 21 of the opposing paddle assembly 17 (shown at 31 in FIG. 1), which will then be in a raised position for engagement by the opposing hand of the user, will cause the lowered paddle assembly 17 (then in the position 29) to be drawn forward, along and adjacent to the inside of the side wall 8, and within the enclosure 2, preventing contact with the lowered hand grip 21 during this forward movement of the paddle assembly 17.

Forward movement of the lowered paddle assembly 17 will continue, responsive to retraction of the hand grip 21 of the opposing paddle assembly 17, until the lowered paddle assembly 17 approaches the forward portions 26 of the enclosure 2. At this point, it becomes desirable to return the lowered paddle assembly 17 to a raised position. To accomplish this, the lowered paddle assembly 17 is caused to pass through a second opening 32 in the side wall 8 which is positioned toward the front of the enclosure 2. The opening 32 is mated with a contoured guide 33 which is formed in the base 7 of the body 4, and which is best seen with reference to FIGS. 8 and 9 of the drawings. The guide 33 is provided with a smoothly curved shaped which is contoured to receive the tip 34 of the hand grip 21 of the lowered paddle assembly 17. Resulting from interaction between the tip 34 of the hand grip 21 and the curved surface of the contoured guide 33, the hand grip 21 of the lowered paddle assembly 17 is moved to a raised position while simultaneously passing through the opening 32. The contoured guide 33 is preferably provided with a rounded corner portion, at 35, to prevent the surface of the hand grip 21 from encountering a resistant surface during its transition to a raised position. Upon complete retraction of the opposing paddle assembly 17, the hand grip 21 will be brought fully forward and to a fully raised position, coming to rest on the forwardmost end 36 of the sill 27 and readying the raised hand grip 21 for engagement by the user during the next swimming stroke to be simulated.

A trap door 37 is pivotally associated with the opening 32, in general alignment with the sill 27 of the side wall 8. A pivot 38 connects the trap door 37 and the sill 27 so that the trap door 37 is raised by a hand grip 21 which is then passing through the opening 32 to the raised position, at 36. Following this, the trap door 37 is allowed to close, by gravity. The trap door 37 is sized so that, when closed, a bridge is formed over the opening 32, completing the sill 27 of the side wall 8. The forwardmost (and raised) hand grip 21 can then be retracted along the sill 27, passing over the opening 32.

The foregoing operations occur both smoothly and continuously, automatically placing the hand grips 21 of the paddle assemblies 17 in position for appropriate, alternating engagement by the hands of the user, in this way facilitating the learning process and establishing a natural cadence for the swimming stroke which is being learned.

In use, one of the hand grips 21 (in the illustration of FIG. 1, the hand grip 21 then in the position 39) will be engaged by one of the user's hands, similar to a swimming stroke, which begins toward the user's head and shoulder (simulating an entry point into the water). Retraction of the engaged hand grip 21 then simulates forward movement of the body as the user pulls his or her hand back toward their thigh. The engaged hand grip 21 will slide along the sill 27 as the paddle assembly 17 is pulled by the user, passing the positions 40*a*, 40*b*, 40*c* shown in FIG. 1. At the point when the user's arm is fully extended, down toward the thigh, proper form calls for the user to raise their hand from the water for return to the point of entry into the water. As one arm finishes its pull, and exits the water, the opposing arm should begin its entry into the water, near the user's head. This alternate arm, entry-and-exit motion is simulated by having one of the user's arms pull the engaged paddle assembly 17 along the sill 27 until the user's hand reaches the user's thigh. At this point (shown at 41 in FIG. 1), the sill 27 ends, the hand grip 21 is released, and the paddle assembly 17 is allowed to drop into the housing 6 of the apparatus 1 (shown at 42 in FIG. 1). The user's arm, which is at this point free and unencumbered, is then rotated forward to await the start of another stroke, when the paddle assembly 17 re-emerges from the enclosure 2 and is raised into position as previously described.

In conjunction with such operation, when the hand grip 21 is released, allowing the paddle assembly 17 to drop into the housing 6 (by gravity) to assume the position 42, the enclosed paddle assembly 17 will be pulled forward (toward the front of the apparatus 1, as shown in FIG. 2) by the cable 22 as the opposing paddle assembly 17 (shown at 43 in FIG. 1) is drawn in the opposite direction. This motion is caused when the engaged paddle assembly 17 (which is on the opposite side of the enclosed paddle assembly 17) is pulled rearward with the opposing hand (shown at 44*a*, 44*b*, 44*c* in FIG. 2).

Figure 8:
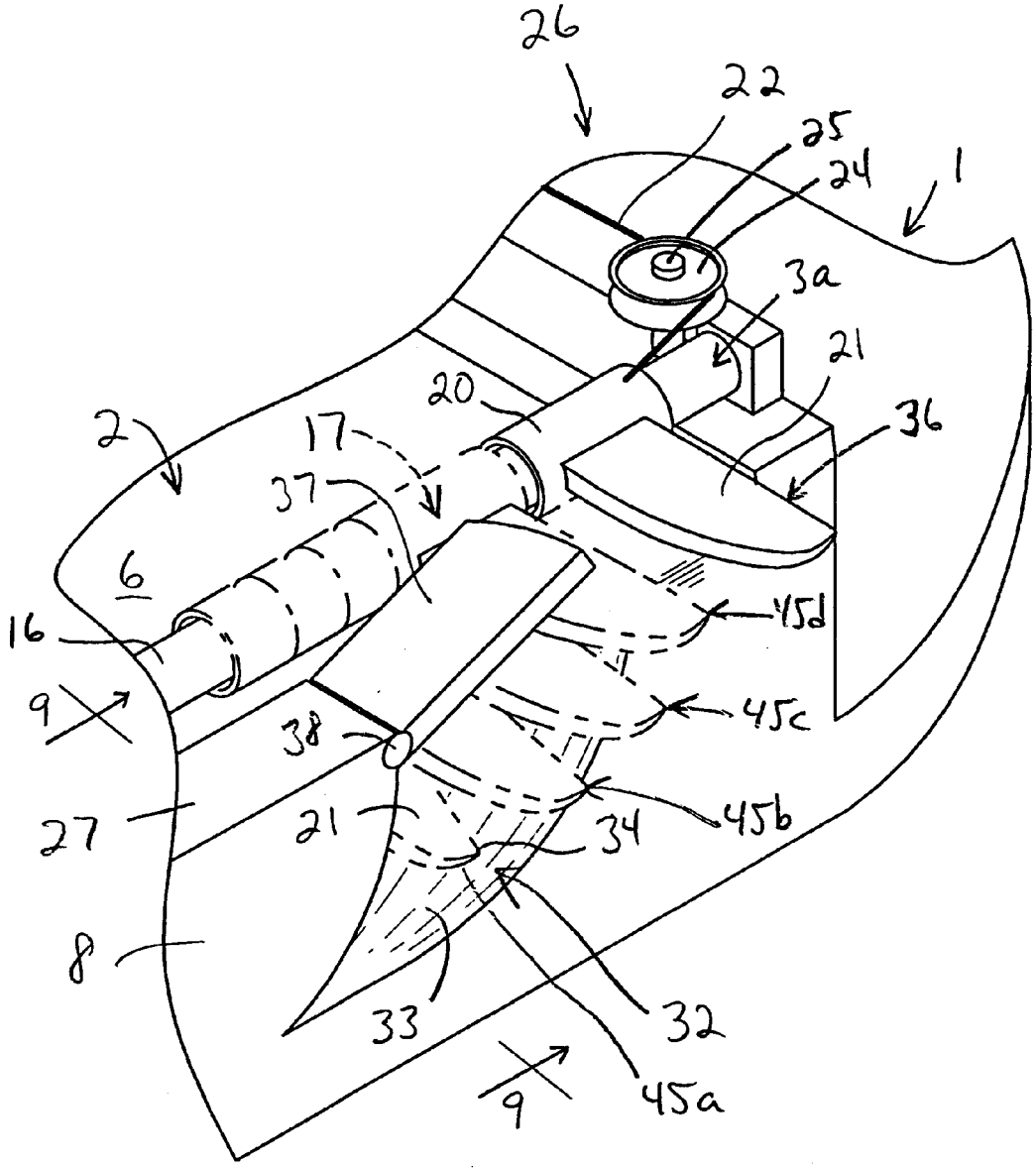
FIG. 8 is an enlarged isometric view showing forward portions of the swim training apparatus shown in FIGS. 1 and 2 as one of the hand grips exits the enclosure, for engagement by the user's hand.
Figure 9:
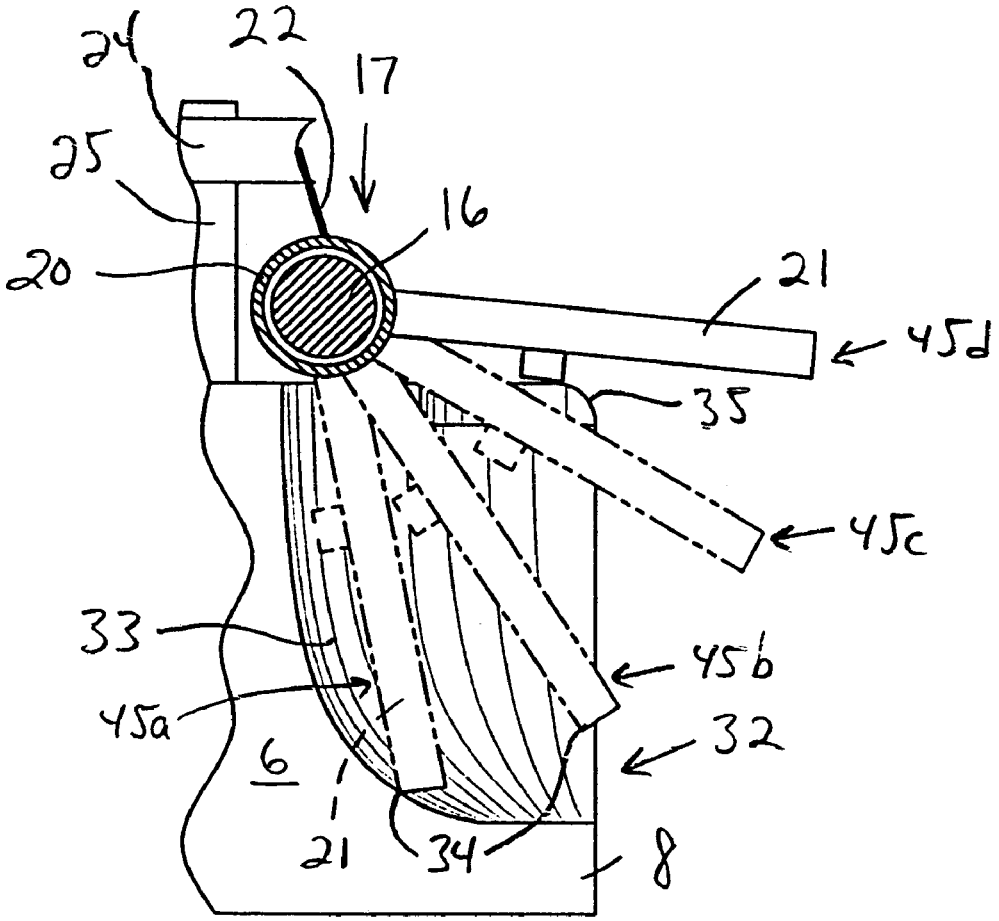
FIG. 9 is a sectional view of the swim training apparatus shown in FIG. 8, taken along the line 9—9.

Referring to FIGS. 8 and 9, as the lowered paddle assembly 17 is moved along the side wall 8, toward the forward portions 26 of the enclosure 2 (i.e., toward the user's head), the hand grip 21 will be guided through the opening 32 in the side wall 8, emerging from the housing 6, responsive to the interaction which is developed between the guide 33 of the enclosure 6 and the tip 34 of the hand grip 21 (shown by the positions 45*a*, 45*b*, 45*c*, 45*d* in FIGS. 8 and 9). As the hand grip 21 emerges from the opening 32, the hand grip 21 will be guided past the trap door 37 and to the position 36. The trap door 37 will then close, by gravity, readying the paddle assembly 17 for the next stroke to be simulated.

It will be understood that various changes in the details, materials and arrangement of parts which have been herein described and illustrated in order to explain the nature of this invention may be made by those skilled in the art within the principle and scope of the invention as expressed in the claims which follow.

For example, and as previously indicated, while the foregoing swim training apparatus 1 has been described for use in simulating a basic "freestyle" or "doggy paddle" stroke, a similarly configured apparatus can be used to simulate other strokes by appropriately modifying the shape, the configuration and/or the relative position of the various components which comprise the swim training apparatus 1 (primarily the hand track systems 3*a*, 3*b* and the body 4 of the enclosure 2). For purposes of simulating swimming strokes that do not employ an alternating arm motion, such as the "breast" and "butterfly" strokes, the connecting cable 22 and the pulleys 24 for receiving the cable 22 will also require modification to permit the simultaneous pulling movement which is required for such strokes to be established for the user's hands and arms, (e.g., by replacing the unitary cable 22 and the pulleys 24 with independent systems including return mechanisms that use springs or some other equivalent means for automatically returning the retracted paddle assemblies 17 to the forward end 26 of the apparatus 1). The outer appearance of the enclosure 2 can also be freely varied, as desired.

Although retraction of the hand grips 21 of the paddle assemblies 17 into the enclosure 2 is presently preferred, it would also be possible to provide the body 4 with continuous side walls (not shown) so that both of the paddle assemblies 17 are maintained in the raised position. However, in such case, and for the reasons previously mentioned, it is believed that a less satisfactory learning experience would result.

Other modifications, both simplified and more complex, will be equally apparent to the skilled artisan, and various optional features may be added to the apparatus, if desired. For example, the apparatus 1 can be provided with a sound-producing mechanism capable of developing suitable (e.g., ocean or Dolphin) sounds, either as background for the user's enjoyment, or which activate only when the paddle assemblies 17 are being utilized correctly, to signal the user that correct swimming technique is being simulated.

The apparatus 1 may also be provided with various convenience features. For example, the enclosure 2 can include front and/or rear wheels for assisting in moving the apparatus 1, or to allow the apparatus 1 to be used as a riding toy. In such cases, two wheels are preferably located at the rear of the apparatus 1, one on each side, to provide a stable base capable of preventing the apparatus 1 from tipping over. The front wheel (or wheels) can further provide a turning capability if desired.

What is claimed is:

1. An apparatus for facilitating practice of a swimming stroke by a user, comprising:

an enclosure including a support surface for receiving the user so that hands and arms of the user are free for movement and so that body portions of the user are supported in a position simulating a position of the user while in water; and a pair of hand track systems associated with the enclosure and located below the support surface, wherein the hand track systems include grip portions which extend from opposing sides of the enclosure;

wherein the grip portions of the hand track systems which extend from the enclosure are positioned for engagement by the hands of the user; and wherein the grip portions can assume either of two positions including a first, raised position in which the grip portions are supported for engagement by the hands of the user and a second, lowered position in which the grip portions are received within the enclosure.

2. The apparatus of claim 1 wherein the grip portions of the hand track systems are releasably engaged by the hands of the user during the practice of the swimming stroke.

3. The apparatus of claim 2 wherein the swimming stroke has a first portion simulating the position during which the hands and arms of the user are in the water and a second portion simulating the position during which the hands and arms of the user are out of the water, and wherein the grip portions are positioned for engagement by the hands of the user during the first portion of the swimming stroke and for release by the hands of the user during the second portion of the swimming stroke.

4. The apparatus of claim 1 wherein the enclosure includes a base for resting upon a supportive surface and for receiving the pair of hand track systems, and a cover supported by the base, for receiving the user.

5. The apparatus of claim 4 wherein the user is supported above the surface so that the hands and arms of the user are free for movement without contacting the surface.

6. The apparatus of claim 4 wherein the cover has a curved surface for receiving the user.

7. The apparatus of claim 6 wherein the curved surface is a concave surface for supporting the user in position on the cover.

8. The apparatus of claim 4 wherein the cover has a substantially flat surface.

9. The apparatus of claim 4 wherein the cover has lateral edges which include bolsters for retaining the user on the cover.

10. The apparatus of claim 4 wherein the cover has lateral edges which include vertical projections for retaining the user on the cover.

11. The apparatus of claim 4 wherein the hand track systems are joined by a cable.

12. The apparatus of claim 11 wherein the cable is adjustably coupled with the hand track systems, for adjusting the hand track systems to the user.

13. The apparatus of claim 11 wherein the cable is received by a pair of pulleys coupled with forward portions of the enclosure, for directing the cable between the hand track systems.

14. The apparatus of claim 13 wherein the pulleys are coupled with the forward portions of the enclosure so that the cable is placed in an orientation which substantially parallels longitudinal axes defined by the hand track systems.

15. The apparatus of claim 11 which further includes means for producing resistance during retraction of the hand track systems.

16. The apparatus of claim 15 wherein the resistance producing means is adjustable, for adjusting forces produced by the resistance producing means.

17. The apparatus of claim 4 wherein the hand track systems each include a rail having a longitudinal axis, and a hand grip which is slidingly received by the rail for movement along the longitudinal axis of the rail and for rotation about the longitudinal axis of the rail.

18. The apparatus of claim 17 wherein the hand grip is coupled with a sleeve for slidingly engaging the rail.

19. The apparatus of claim 17 wherein the rail is substantially linear.

20. The apparatus of claim 17 wherein the rail is contoured.

21. The apparatus of claim 17 wherein the rails are positioned along and inboard from the opposing sides of the enclosure.

22. The apparatus of claim 21 wherein the sides of the enclosure each include a sill for receiving and supporting the hand grip in the raised position.

23. The apparatus of claim 22 wherein each of the sides includes means for adjusting the length of the sill to the user.

24. The apparatus of claim 23 wherein the length adjusting means is a door coupled with each of the sides.

25. The apparatus of claim 24 wherein the door is a pocket door received within the sides of the enclosure.

26. The apparatus of claim 22 wherein the sides have a first opening which defines an end of the sill, for receiving the hand grip within the enclosure when the hand grip is moved beyond the end of the sill and for transferring the hand grip from the first position to the second position.

27. The apparatus of claim 26 wherein the sides have a second opening at an end of the enclosure opposite to the first opening, and wherein the second opening includes means for raising a hand grip in the second position to a hand grip in the first position as the hand grip is moved forward to the end of the enclosure.

28. The apparatus of claim 27 wherein the raising means is a contoured surface extending from base portions of the enclosure to the second opening, for engaging tip portions of the hand grip.

29. The apparatus of claim 28 wherein the contoured surface is a smoothly curving surface which extends from the base portions of the enclosure to the second opening.

30. The apparatus of claim 28 which further includes a trap door which is coupled with the sill, for passing the hand grip from the enclosure while preventing the hand grip from returning to the enclosure after the hand grip has been returned to the first position.

31. The apparatus of claim 30 wherein the trap door has rear edge portions for completing the sill, and a pivot for connecting the rear edge portions of the trap door to the sill.

32. The apparatus of claim 31 wherein the trap door has a length which substantially corresponds to the second opening.

* * * * *